US011668513B2

(12) United States Patent
Hanson et al.

(10) Patent No.: US 11,668,513 B2
(45) Date of Patent: Jun. 6, 2023

(54) STAGED ACCESS DOOR FOR A HOME APPLIANCE

(71) Applicant: Electrolux Home Products, Inc., Charlotte, NC (US)

(72) Inventors: Josh Hanson, Charlote, NC (US); Saba Rizzi, Charlote, NC (US); Brent Aaron Curtis, Terrell, NC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 17/533,554

(22) Filed: Nov. 23, 2021

(65) Prior Publication Data

US 2022/0170689 A1 Jun. 2, 2022

Related U.S. Application Data

(63) Continuation-in-part of application No. 17/108,692, filed on Dec. 1, 2020, now Pat. No. 11,215,391.

(51) Int. Cl.

| | |
|---|---|
| ***F25D 23/02*** | (2006.01) |
| ***E05B 65/00*** | (2006.01) |
| ***E05C 3/16*** | (2006.01) |

(52) U.S. Cl.

CPC ..... *F25D 23/028* (2013.01); *E05B 65/0042* (2013.01); *E05C 3/16* (2013.01); *F25D 23/025* (2013.01); *F25D 2323/021* (2013.01)

(58) Field of Classification Search

CPC .. F25D 23/025; F25D 23/04; F25D 2323/023; F25D 23/02; F25D 23/028; F25D 23/12; F25D 25/02; F25D 25/022; F25D 23/067; F25D 2325/021; F25D 25/024; F25D 2323/021; E05B 65/0042; E05B 1/0015; E05B 1/0038; E05C 3/16

See application file for complete search history.

(56) References Cited

U.S. PATENT DOCUMENTS

| | | | | |
|---|---|---|---|---|
| 2,639,182 | A * | 5/1953 | Jacobson | E05B 65/0042 292/332 |
| 3,086,830 | A | 4/1963 | Malia | |
| D642,600 | S | 8/2011 | Kristiansen et al. | |

(Continued)

FOREIGN PATENT DOCUMENTS

| | | |
|---|---|---|
| KR | 20140104243 | 8/2014 |
| KR | 1020150077480 | 7/2015 |

(Continued)

OTHER PUBLICATIONS

International Search Report for PCT/US2021/060499 dated Mar. 3, 2022, 2 pages.

*Primary Examiner* — Hiwot E Tefera
(74) *Attorney, Agent, or Firm* — Pearne & Gordon LLP

(57) ABSTRACT

A refrigerator that includes a cabinet housing a refrigerator compartment and having a front opening. A door provides access to the refrigerator compartment. The door includes a first section and a second section. A locking mechanism is provided for selectively securing the second section to the first section when the second section is in a closed position relative to the first section. The locking mechanism includes a handle disposed within an elongated recess of the second section. A latch hook is engageable with the handle for selectively locking the second section in the closed position relative to the first section.

11 Claims, 11 Drawing Sheets

(56) References Cited

U.S. PATENT DOCUMENTS

| | | | | |
|---|---|---|---|---|
| D646,308 | S | 10/2011 | Kristiansen et al. | |
| 3,052,236 | A1 | 11/2011 | Kim | |
| D692,929 | S | 11/2013 | Seo et al. | |
| D707,735 | S | 6/2014 | Cho et al. | |
| 8,752,916 | B2 | 6/2014 | Kwon | |
| 8,851,589 | B2 | 10/2014 | Gwak | |
| D723,595 | S | 3/2015 | You et al. | |
| 9,046,294 | B2 | 6/2015 | Lee et al. | |
| 9,103,581 | B2 | 8/2015 | Babinski | |
| D738,941 | S | 9/2015 | Shin et al. | |
| 9,175,902 | B2 | 11/2015 | Oh et al. | |
| 9,267,727 | B2 * | 2/2016 | Lim | F25D 23/00 |
| 9,285,155 | B2 | 3/2016 | Yoo et al. | |
| 9,410,732 | B2 * | 8/2016 | Choi | F25D 23/00 |
| 9,518,777 | B2 | 12/2016 | Lee et al. | |
| 9,568,239 | B2 | 2/2017 | Kim et al. | |
| 9,651,295 | B2 | 5/2017 | Kim et al. | |
| 9,777,958 | B2 | 10/2017 | Choi et al. | |
| 9,810,475 | B2 | 11/2017 | Kim et al. | |
| 10,295,248 | B2 | 5/2019 | Miller et al. | |
| 10,436,499 | B2 | 8/2019 | Jung | |
| 10,539,359 | B2 | 1/2020 | Kwon | |
| 10,568,441 | B2 | 2/2020 | Lee et al. | |
| 10,598,422 | B2 | 3/2020 | Park et al. | |
| 10,962,279 | B1 | 3/2021 | Scalf | |
| 2010/0175414 | A1 | 7/2010 | Kim | |
| 2010/0176702 | A1 | 7/2010 | Kim | |
| 2014/0062283 | A1 | 3/2014 | Baldo | |
| 2014/0360220 | A1 | 12/2014 | Rackley | |
| 2015/0069900 | A1 * | 3/2015 | Lim | F25D 23/028 312/405 |
| 2015/0137674 | A1 * | 5/2015 | Choi | F25D 23/062 312/405 |
| 2015/0233629 | A1 | 8/2015 | Choi | |
| 2015/0241116 | A1 * | 8/2015 | Choi | E05B 65/0042 312/405 |
| 2016/0138855 | A1 | 5/2016 | Choo et al. | |
| 2016/0258670 | A1 | 9/2016 | Deka et al. | |
| 2017/0051542 | A1 * | 2/2017 | Reske | E05B 63/244 |
| 2017/0175423 | A1 * | 6/2017 | Gresham, IV | F25D 23/025 |
| 2017/0176086 | A1 | 6/2017 | Kang | |
| 2017/0191740 | A1 | 7/2017 | Jung | |
| 2017/0211874 | A1 | 7/2017 | Kim | |
| 2017/0219275 | A1 | 8/2017 | Suh et al. | |
| 2017/0284729 | A1 | 10/2017 | Lim | |
| 2018/0120020 | A1 * | 5/2018 | Lee | F25D 23/02 |
| 2018/0156529 | A1 * | 6/2018 | Wantland | F25D 23/025 |
| 2018/0164022 | A1 | 7/2018 | Ding et al. | |
| 2018/0187953 | A1 | 7/2018 | Lv et al. | |
| 2018/0335245 | A1 * | 11/2018 | Lee | F25D 23/02 |
| 2018/0347893 | A1 | 12/2018 | Karl | |
| 2019/0031001 | A1 | 1/2019 | Guempel | |
| 2019/0338999 | A1 * | 11/2019 | Lee | E05B 63/248 |
| 2019/0366074 | A1 | 12/2019 | Carlton et al. | |
| 2020/0208902 | A1 | 7/2020 | Yu | |
| 2021/0239386 | A1 * | 8/2021 | Yoon | E05C 3/162 |
| 2021/0372689 | A1 * | 12/2021 | Park | F25D 23/04 |

FOREIGN PATENT DOCUMENTS

| | | |
|---|---|---|
| KR | 201800545538 | 5/2018 |
| WO | 2004059228 | 7/2004 |
| WO | 2016060531 | 4/2016 |

* cited by examiner

STAGED ACCESS DOOR FOR A HOME APPLIANCE

CROSS-REFERENCE TO RELATED APPLICATIONS

This application is a continuation-in-part of U.S. application Ser. No. 17/108,692 filed on Dec. 1, 2020. This application is incorporated herein by reference.

FIELD OF THE INVENTION

The instant invention is directed to a staged access door for a home appliance, such as a refrigerator.

BACKGROUND OF THE INVENTION

Conventional refrigeration appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerators are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another in such refrigerators vary. For example, in some cases, the freezer compartment is located above the fresh food compartment and in other cases the freezer compartment is located below the fresh food compartment. Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment can be accessed without exposing the other compartment to the ambient air.

The access door to the compartments, for example the refrigerator compartment, is a feature that can enhance the marketability of the appliance. For example, being able to view the content of the compartment without opening the door, may be a desirable feature. Also, adding storage to the door may also be a desirable feature.

Additionally, the ability to vary the configuration of the door may be desirable. Or providing an accessible storage space within the door, that may be accessed without opening the door, could also be desirable. Accordingly, there is a need for new access doors for home appliances.

SUMMARY OF THE INVENTION

There is provided a refrigerator that includes a cabinet housing a refrigerator compartment and having a front opening. A door provides access to the refrigerator compartment. The door is moveable between a closed position wherein the opening is closed and an open position wherein the refrigerator compartment is accessible. The door includes a first section having an opening for receiving items, a first lateral edge and a second lateral edge. The first lateral edge is hingeably affixed to the cabinet. A second section of the door has a first lateral edge hingeably affixed to the first lateral edge of the first section and pivotal relative to the first section between a closed position wherein the opening in the first section is closed and an open position wherein the opening in the first section is accessible. The second section includes an elongated recess formed in an opposite second lateral edge. A locking mechanism is provided for selectively securing the second section to the first section when the second section is in the closed position. The locking mechanism includes a handle disposed within the elongated recess of the second section. A latch hook is engageable with the handle for selectively locking the second section in the closed position relative to the first section.

In another embodiment, the handle is slideable within the elongated recess and is configured to move the latch hook from a locked position to an unlocked position.

In yet another embodiment, the handle is slideable in a direction perpendicular to a longitudinal axis of the elongated recess.

In another embodiment, a biasing element is provided for biasing the latch hook into a locked position.

In another embodiment, the biasing element is a torsional spring, a leaf spring, a compression spring or an extension spring.

In yet another embodiment, the handle includes a protrusion that engages the latch hook for moving the latch hook from a locked position to an unlocked position when the handle slides in a first direction within the elongated recess.

In another embodiment, the protrusion engages an opening formed in the latch hook.

In yet another embodiment, the protrusion engages a ramped portion on an edge of the latch hook.

In yet another embodiment, an indicator is on a front surface of the second section that is positioned proximate the handle.

DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DESCRIPTION OF THE INVENTION

Figure 1:
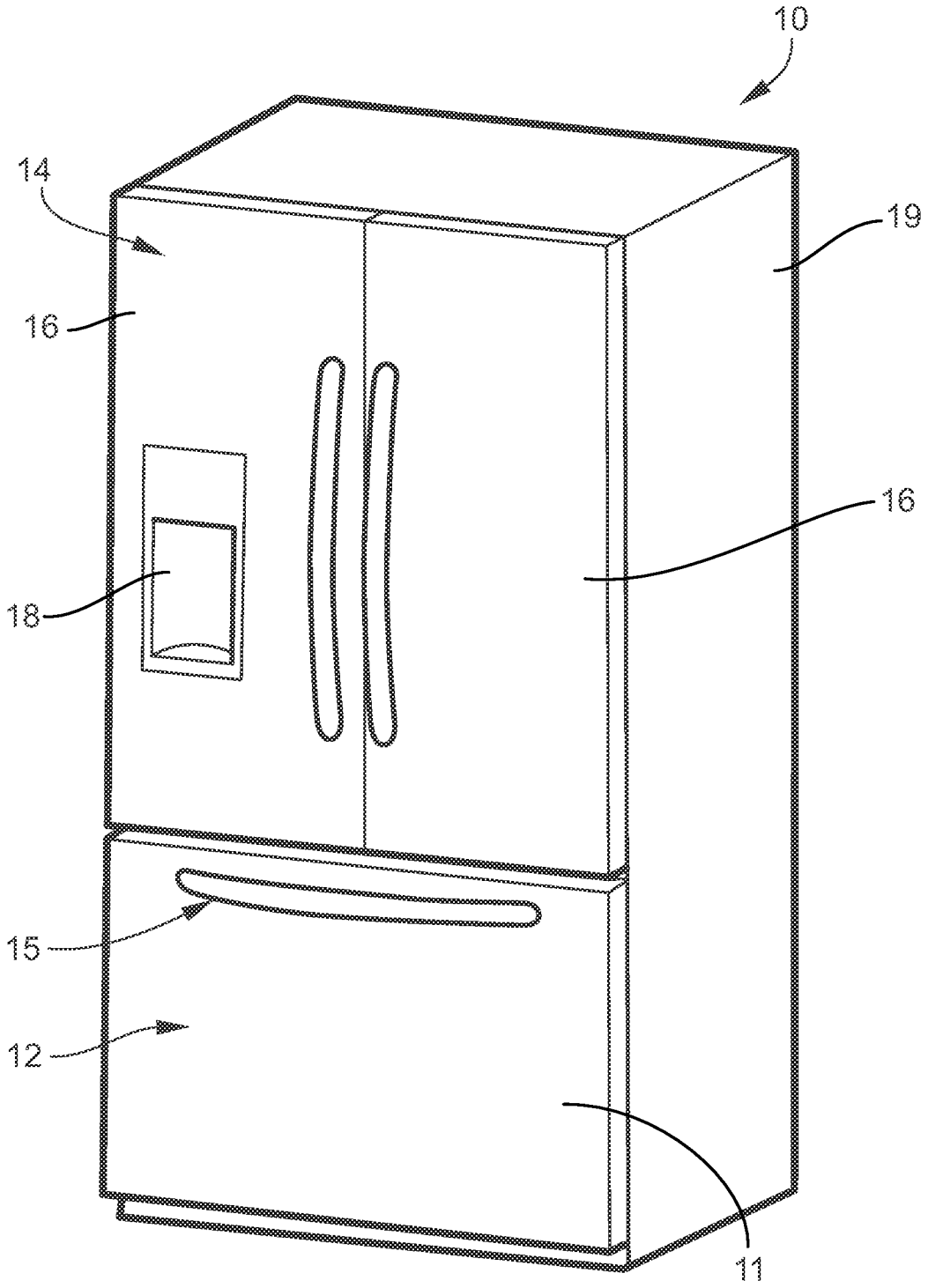
FIG. 1 is a front perspective view of a prior art household French door bottom mount refrigeration appliance showing doors of the fresh food compartment and drawer of a freezer compartment in a closed position.

Embodiments of a refrigerator or a component thereof now will be described with reference to the accompanying drawings. Whenever possible, the same reference numerals are used throughout the drawings to refer to the same or like parts.

Figure 2:
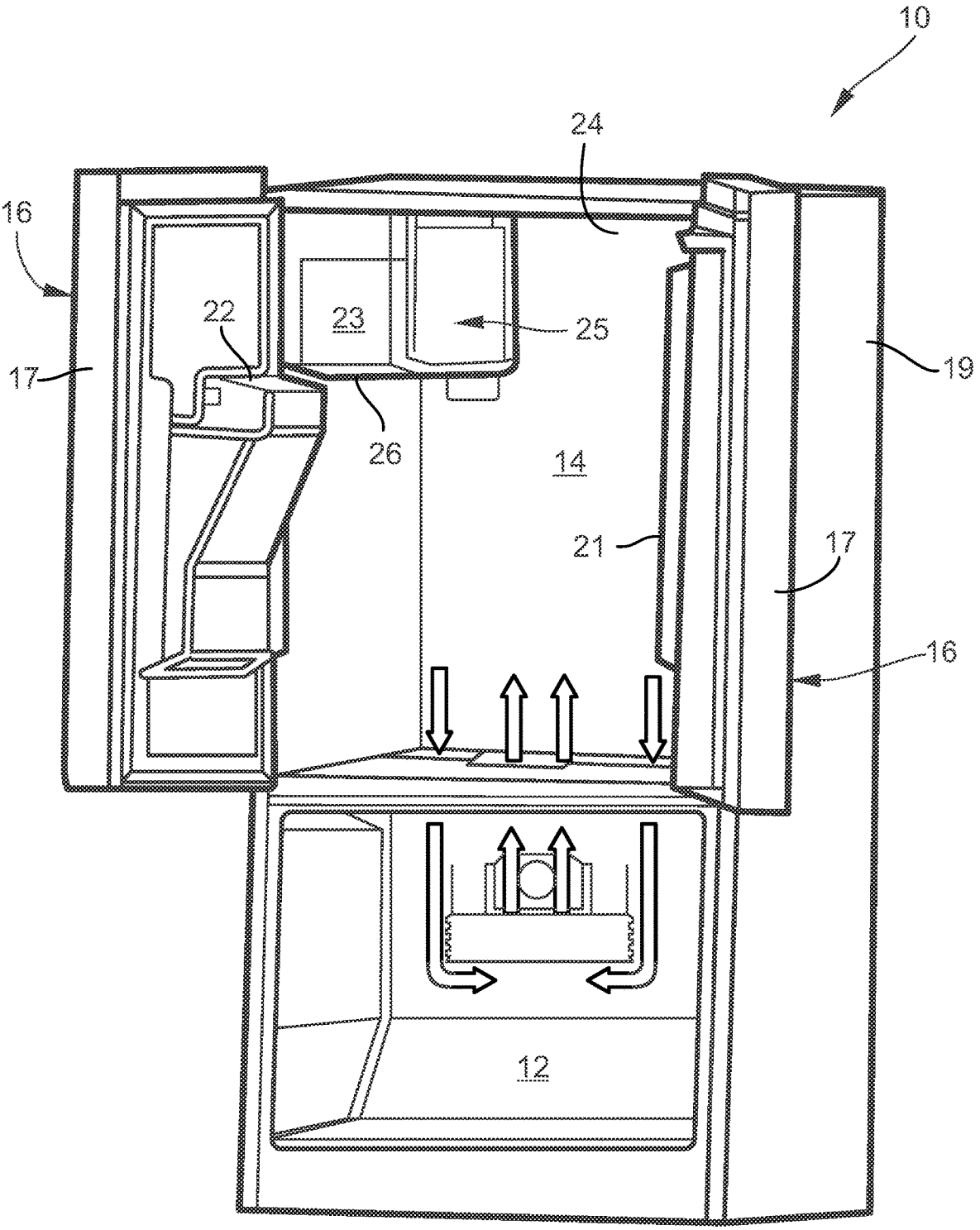
FIG. 2 is a front perspective view of the prior art refrigeration appliance of FIG. 1 showing the doors of the fresh food compartment in opened positions and the drawer of the freezer compartment removed.

Referring now to the drawings, FIGS. 1 and 2 show a refrigeration appliance in the form of a domestic refrigerator, indicated generally at 10. Although the detailed description that follows concerns a domestic refrigerator 10, the invention can be embodied by refrigeration appliances other than a domestic refrigerator 10. An embodiment is described in detail below, and shown in the figures as a bottom-mount configuration of a refrigerator 10, including a fresh food compartment 14 disposed vertically above a freezer compartment 12. However, the refrigerator 10 can have any desired configuration including at least a fresh food compartment 14 and/or a freezer compartment 12, such as a top mount refrigerator (freezer disposed above the fresh food compartment), a side-by-side refrigerator (fresh food compartment is laterally next to the freezer compartment), a standalone refrigerator or freezer, etc.

One or more doors 16 shown in FIG. 1 are pivotably coupled to a cabinet 19 of the refrigerator 10 to restrict and grant access to the fresh food compartment 14. The door 16 can include a single door that spans the entire lateral distance across the entrance to the fresh food compartment 14, or can include a pair of French-type doors 16 as shown in FIG. 1 that collectively span the entire lateral distance of the entrance to the fresh food compartment 14 to enclose the fresh food compartment 14.

For the latter configuration, a center flip mullion 21 (FIG. 2) is pivotally coupled to at least one of the doors 16 to establish a surface against which a seal provided to the other one of the doors 16 can seal the entrance to the fresh food compartment 14 at a location between opposing side surfaces 17 (FIG. 2) of the doors 16. The mullion 21 can be pivotably coupled to the door 16 to pivot between a first orientation that is substantially parallel to a planar surface of the door 16 when the door 16 is closed, and a different orientation when the door 16 is opened. The externally-exposed surface of the center mullion 21 is substantially parallel to the door 16 when the center mullion 21 is in the first orientation and forms an angle other than parallel relative to the door 16 when the center mullion 21 is in the second orientation. The seal and the externally exposed surface of the mullion 21 cooperate approximately midway between the lateral sides of the fresh food compartment 14.

A dispenser 18 (FIG. 1) for dispensing at least ice pieces, and optionally water, can be provided on an exterior of one of the doors 16 that restricts access to the fresh food compartment 14. The dispenser 18 includes an actuator (e.g., lever, switch, proximity sensor, etc.) to cause frozen ice pieces to be dispensed from an ice bin 23 (FIG. 2) of an ice maker 25 disposed within the fresh food compartment 14. Ice pieces from the ice bin 23 can exit the ice bin 23 through an aperture 26 and be delivered to the dispenser 18 via an ice chute 22 (FIG. 2), which extends at least partially through the door 16 between the dispenser 18 and the ice bin 23.

The freezer compartment 12 is arranged vertically beneath the fresh food compartment 14. A drawer assembly (not shown) including one or more freezer baskets (not shown) can be withdrawn from the freezer compartment 12 to grant a user access to food items stored in the freezer compartment 12. The drawer assembly can be coupled to a freezer door 11 that includes a handle 15. When a user grasps the handle 15 and pulls the freezer door 11 open, at least one or more of the freezer baskets is caused to be at least partially withdrawn from the freezer compartment 12.

In alternative embodiments, the ice maker is located within the freezer compartment. In this configuration, although still disposed within the freezer compartment, at least the ice maker (and possible an ice bin) is mounted to an interior surface of the freezer door. It is contemplated that the ice mold and ice bin can be separate elements, in which one remains within the freezer compartment and the other is on the freezer door.

The freezer compartment 12 is used to freeze and/or maintain articles of food stored in the freezer compartment 12 in a frozen condition. For this purpose, the freezer compartment 12 is in thermal communication with a freezer evaporator (not shown) that removes thermal energy from the freezer compartment 12 to maintain the temperature therein at a temperature of 0° C. or less during operation of the refrigerator 10, preferably between 0° C. and −50° C., more preferably between 0° C. and −30° C. and even more preferably between 0° C. and −20° C.

The refrigerator 10 includes an interior liner 24 (FIG. 2) that defines the fresh food compartment 14. The fresh food compartment 14 is located in the upper portion of the refrigerator 10 in this example and serves to minimize spoiling of articles of food stored therein. The fresh food compartment 14 accomplishes this aim by maintaining the temperature in the fresh food compartment 14 at a cool temperature that is typically above 0° C., so as not to freeze the articles of food in the fresh food compartment 14. It is contemplated that the cool temperature preferably is between 0° C. and 10° C., more preferably between 0° C. and 5° C. and even more preferably between 0.25° C. and 4.5° C.

According to some embodiments, cool air from which thermal energy has been removed by the freezer evaporator can also be blown into the fresh food compartment 14 to maintain the temperature therein greater than 0° C. preferably between 0° C. and 10° C., more preferably between 0° C. and 5° C. and even more preferably between 0.25° C. and 4.5° C. For alternate embodiments, a separate fresh food evaporator can optionally be dedicated to separately maintaining the temperature within the fresh food compartment 14 independent of the freezer compartment 12.

According to an embodiment, the temperature in the fresh food compartment 14 can be maintained at a cool temperature within a close tolerance of a range between 0° C. and 4.5° C., including any subranges and any individual temperatures falling with that range. For example, other embodiments can optionally maintain the cool temperature within the fresh food compartment 14 within a reasonably close tolerance of a temperature between 0.25° C. and 4° C.

Figure 3:
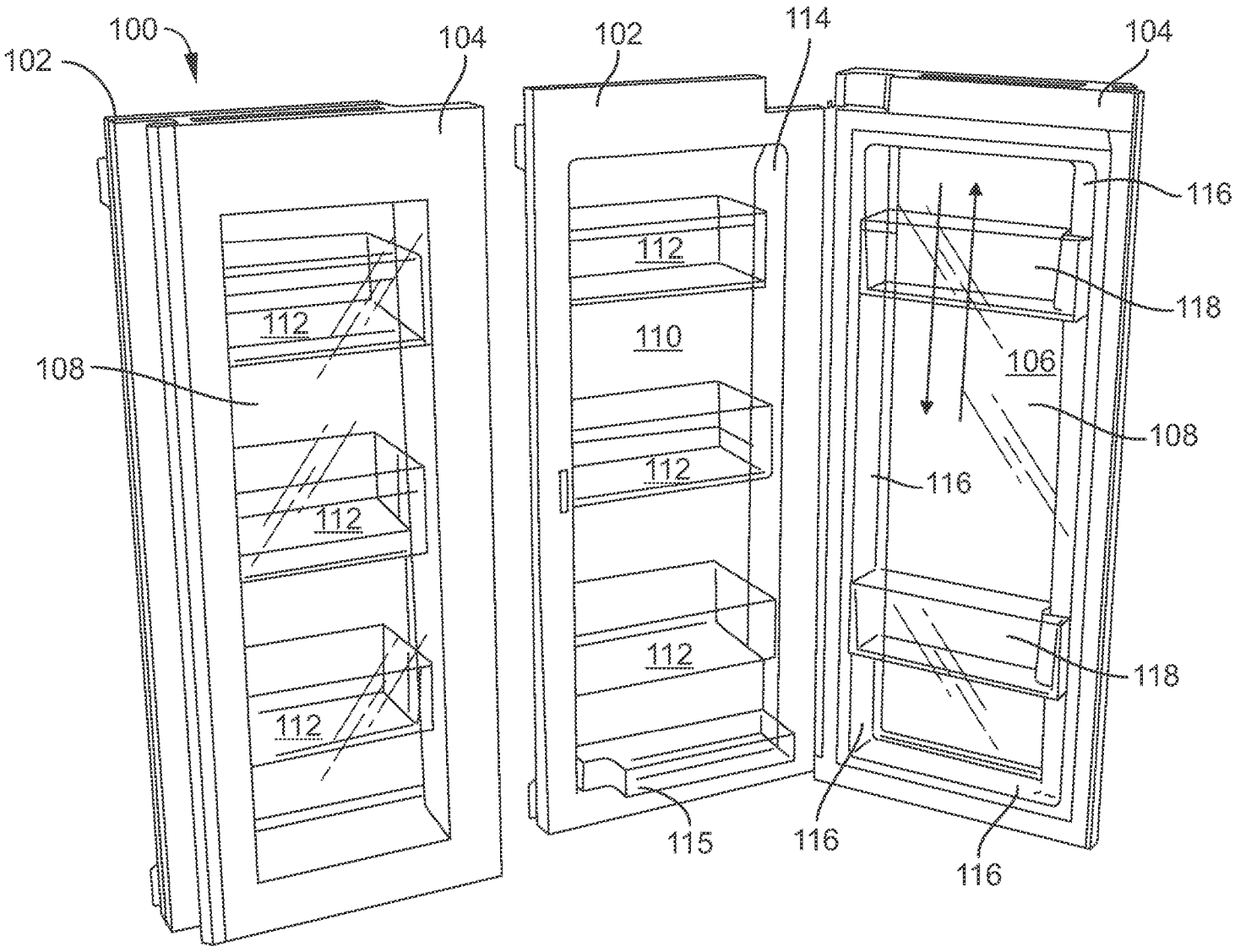
FIG. 3 is an illustration of an embodiment of the inventive door, on the left the door is shown closed and the right the door is shown open.

Referring to FIGS. 3-11, an embodiment of the staged access door will be described. In general (e.g., see FIG. 3), the stage access door 100, which is mounted on cabinet 19 (now shown) may have a first section 102 and a second section 104 with a cavity 106 therebetween with a glass panel 108 closing the cavity 106. In FIG. 3, door 100 (on the left) is in a closed position against the cabinet 19 and door 100 (on the right) is in an open position (second section 104 swung away from first section 102). The refrigerator compartment may be a fresh food compartment or a freezer compartment (as described above).

First section 102 may also include: an opening 110 that allows ingress into the compartment of the cabinet 19 (not shown in FIGS. 3-11) when the second section 104 is in the open position; at least one movable (and removable) pocket shelf (drawer/bin) 112 that are movable on (and removeable from) vertical rails 114 on lateral sides of the opening 110; and a fixed (but removable) shelf (drawer/bin) 115 that may extend into cavity 106. When the second section 104 is in the open position access to stored items on the shelves 112/115 should be possible, but only limited access to items stored in the compartment may be possible, items in the compartment are best accessed with the door 100 is an open position (e.g., both sections 102/104 are swung away from the compartment opening).

The first section 102 and the second section 104 are spaced apart to define a cavity 106. The cavity 106 is further defined by a peripheral wall 116 (in one embodiment—that wall 116 being defined by the second section 102 (shown, FIG. 3) and, in some embodiments, fixed (bottom) shelf 115. Cavity 106 provides a storage space that may be accessed when second section 104 is in the open position.

Figure 4:
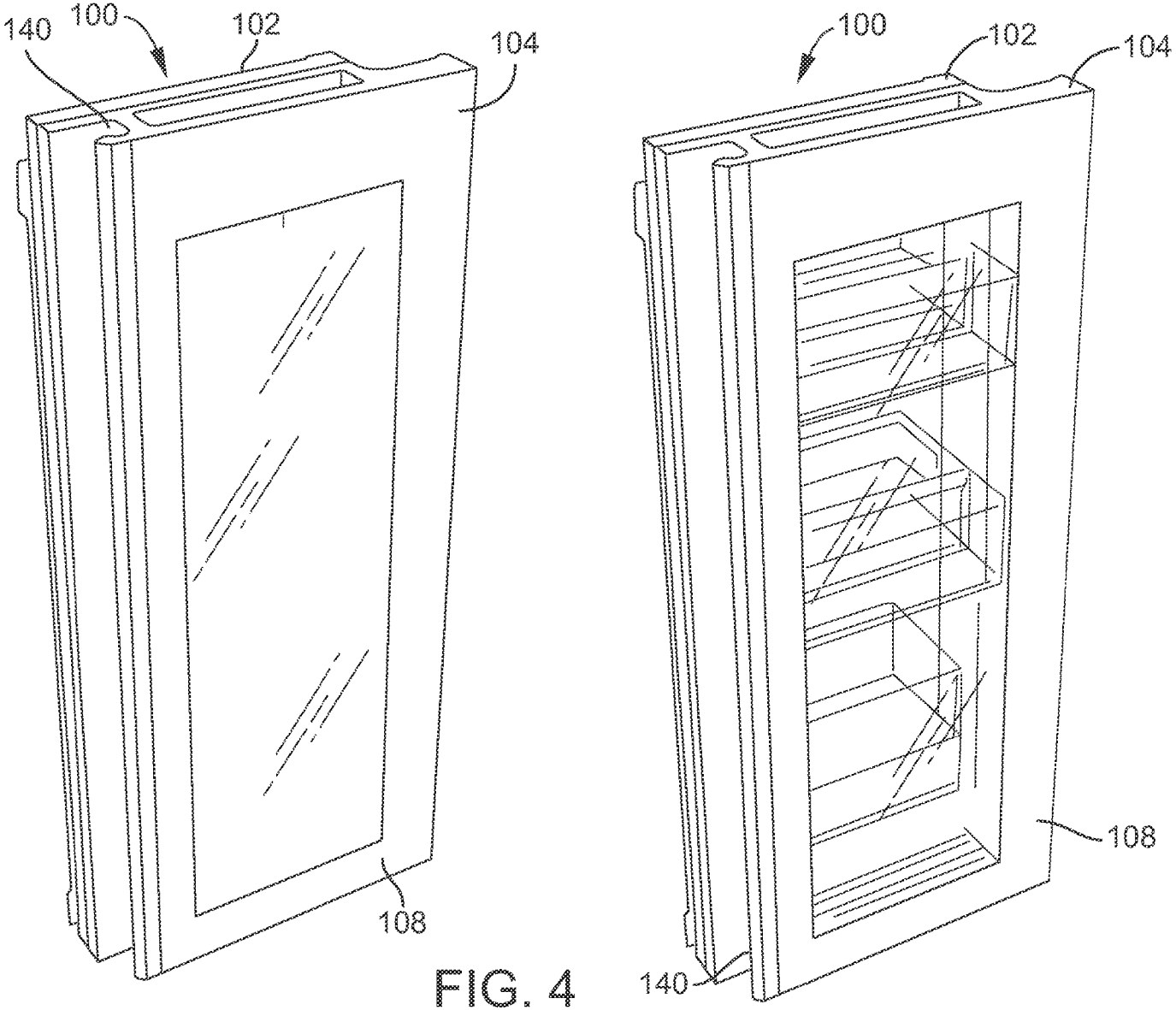
FIG. 4 is an illustration of an embodiment of the inventive door, on the left the door is shown with a dark tinted glass and the right the door is shown with a translucent tinted glass.

Second section 104 may also include: at least one moveable (and removable) pocket shelf (drawer/bin) 118 and in some embodiments (shown) may be mounted on lateral sides of the peripheral wall 116; and a pocket handle 140 (see FIG. 4). Pocket handle 140 is integral with second section 104 and on a side opposite the hinged between sections 102 and 104 and is defined by a channel, e.g. a vertical channel. When second section 104 is in the open position, items stored in the cavity 106 are accessible and, as discussed above, access to items stored on the shelves 112/115 and items in the compartment is possible.

As mentioned above, door 100 includes the first section 102 and the second section 104. First section 102 has two (first and second) lateral (vertical) edge portions. The first edge portion is hingeably connected to the cabinet. The second section 104 is hingeably connected to the first edge portion of the first section 102 such that both the first section 102 and the second section 104 pivot about the same vertical side of the refrigerator 10.

Figure 8:
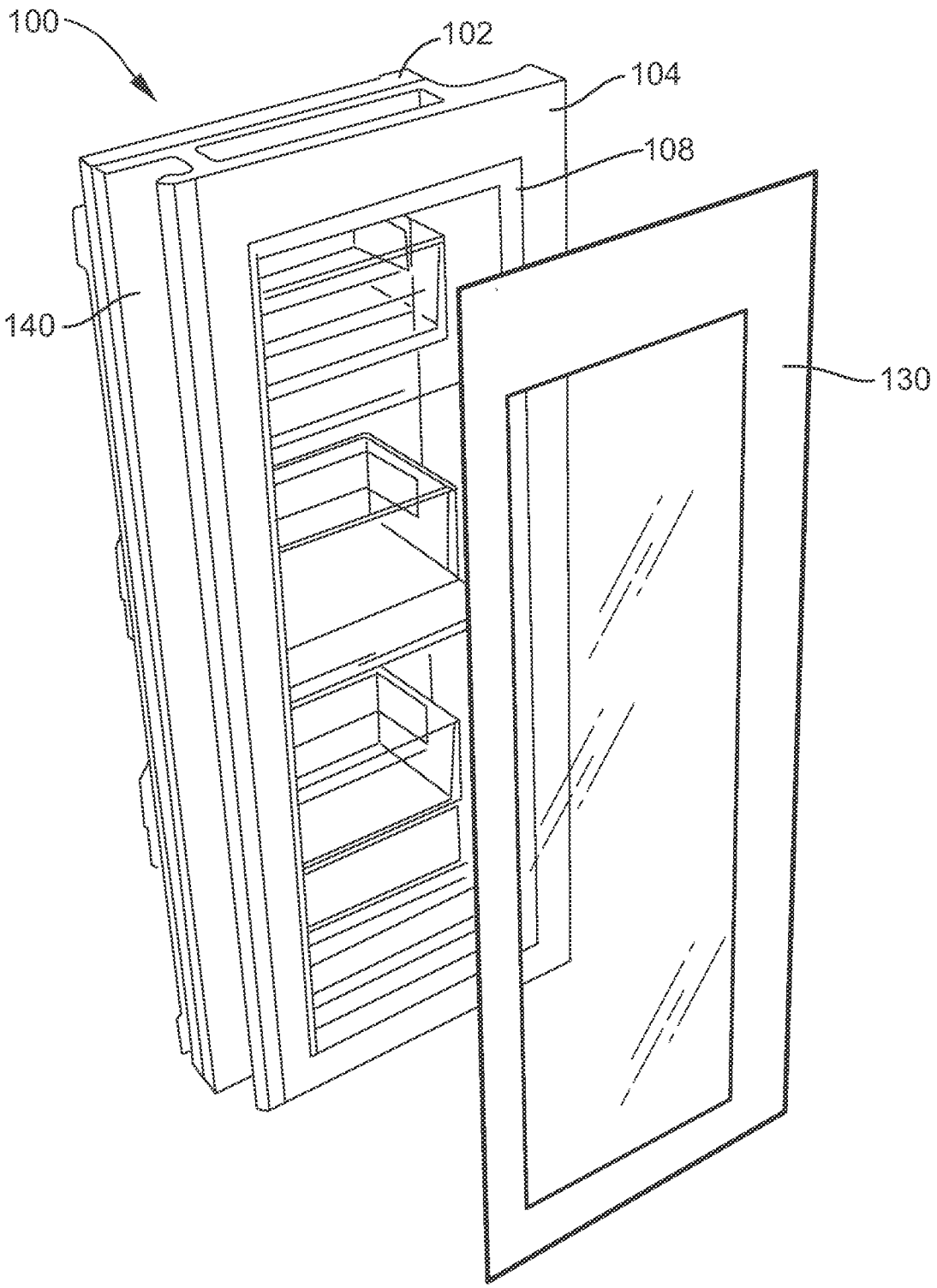
FIG. 8 is an illustration of an embodiment using a double paned vacuum glass with a tinted laminate applied to the glass.

FIGS. 4 and 8 illustrate embodiments of the glass panel 108. FIG. 4 illustrates that glass panel 108 may be tinted (and/or shaded) different colors and opacities. FIG. 8 illustrates that the glass panel 108 may be formed with a vacuum sealed double glass unit (commercially available) and that tinting and/or shading may be obtained with laminates 130 (commercially available). It is also contemplated that the glass panel 108 may extend, substantially or completely, to all four edges of the second section 104 and be attached via an adhesive to a frame of the second section 104. It is contemplated that the frame of the second section 104 may be made of plastic.

Figure 5:
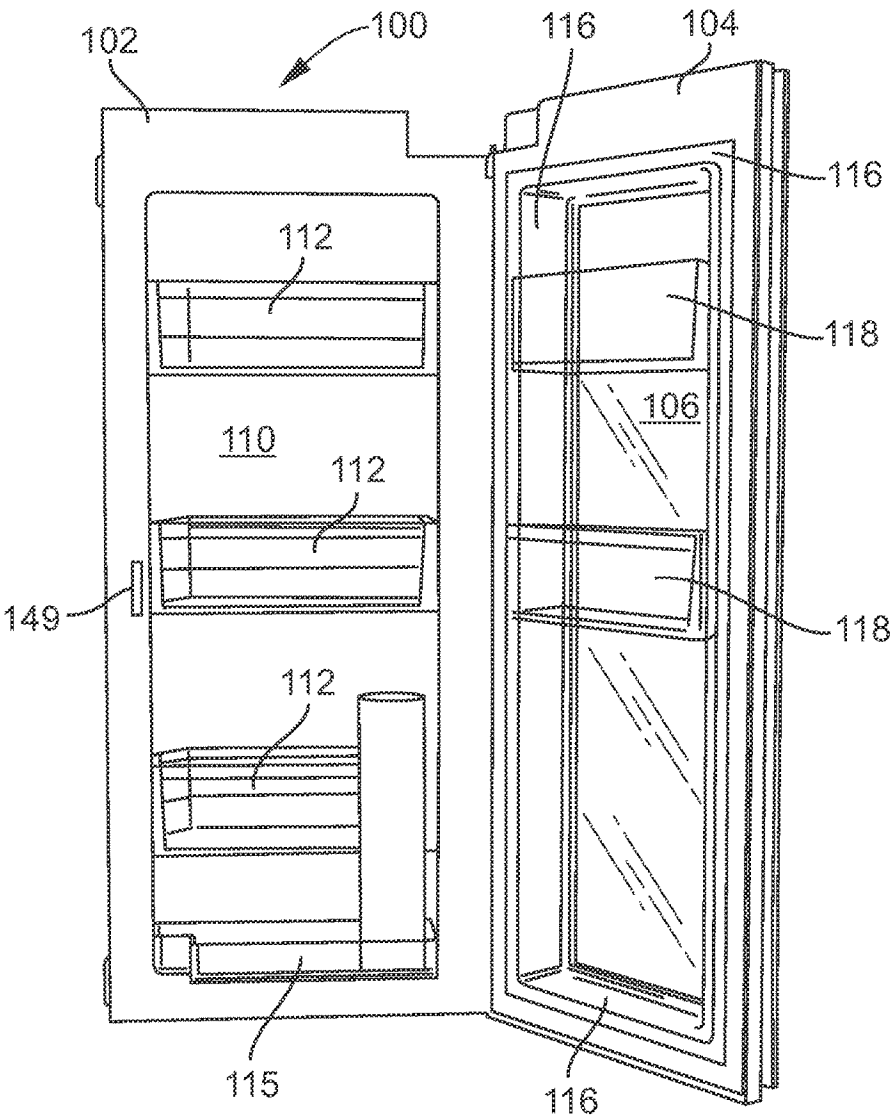
FIG. 5 is an illustration of an embodiment of the inventive door, on the left the door is shown closed with a tall object in the cavity between the first and second door sections and the right the same door is shown closed.
Figure 5:
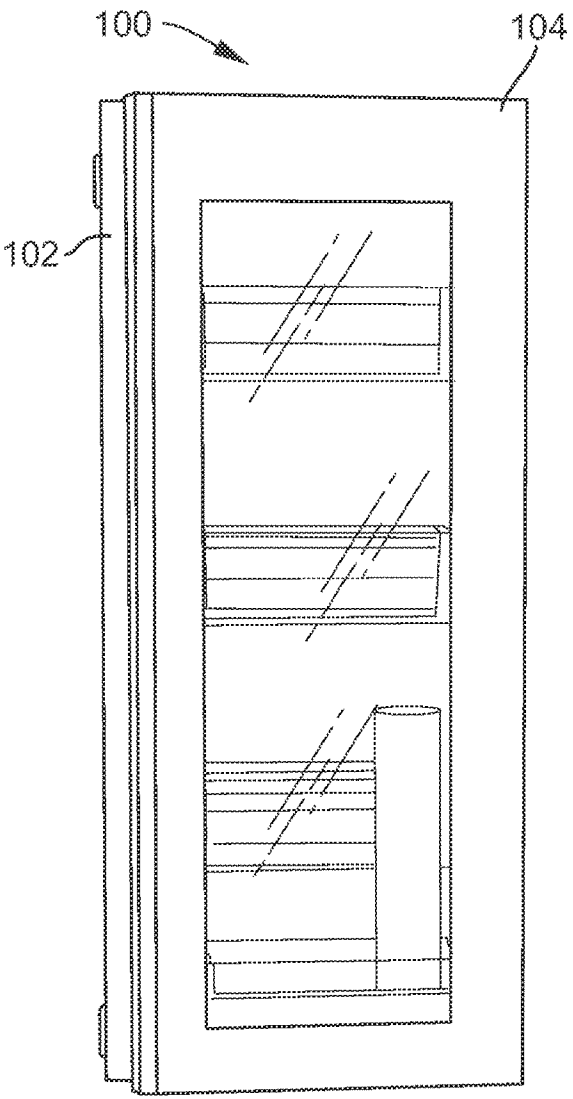
Figure 6:
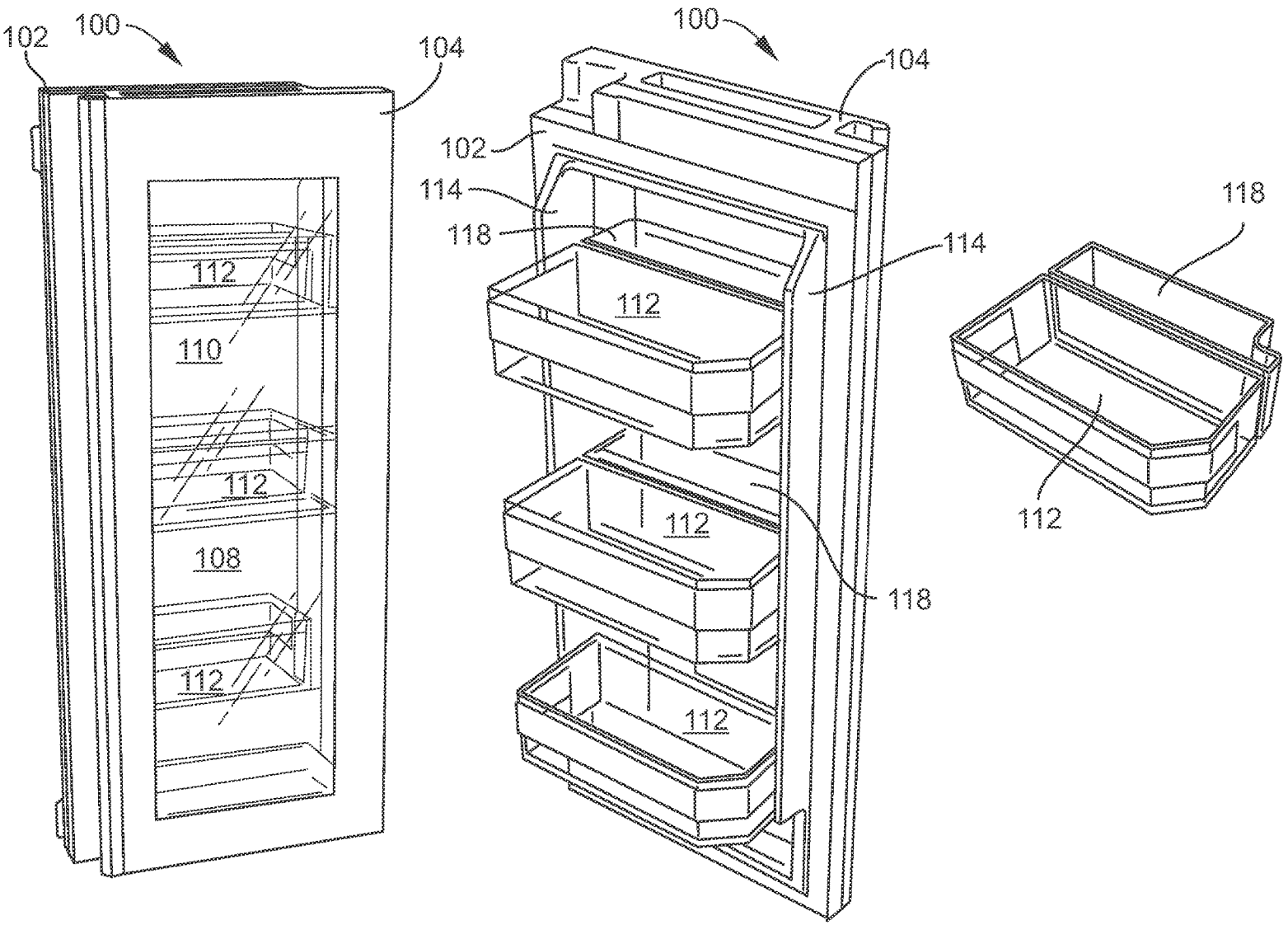
FIG. 6 is an illustration of an embodiment of the inventive door, on the left the door is shown closed and in the center the interior of the door is shown, and on the right an embodiment of a drawer for the interior of the door is shown.

FIG. 5 further illustrates the storage capability of cavity 106. Note the tall cylindrical item resting on shelf 115 at the bottom of cavity 106. Adjustability of the shelves (bins) 118 allows numerous storage capabilities. When shelf (bin) 112 and shelf (bin) 118 are misaligned (FIGS. 5 & 6 illustrate aligned shelves/bins), the space between shelf (bin) 112 and shelf (bin) 118 serve as a divider. When shelf (bin) 112 and shelf (bin) 118 are misaligned (FIGS. 5 & 6 illustrate aligned shelves/bins), misalignment is helpful in securing tall items on the shelf (or within the bin).

FIG. 6 further illustrates that opening 110 and glass panel 108 may define a substantial area of sections 102 and 104. 'Substantial,' as used herein, refers to at least 50% of the area and up to 95% of the area (including all subsets subsumed therein, e.g., 50-80% and the like).

Figure 9:
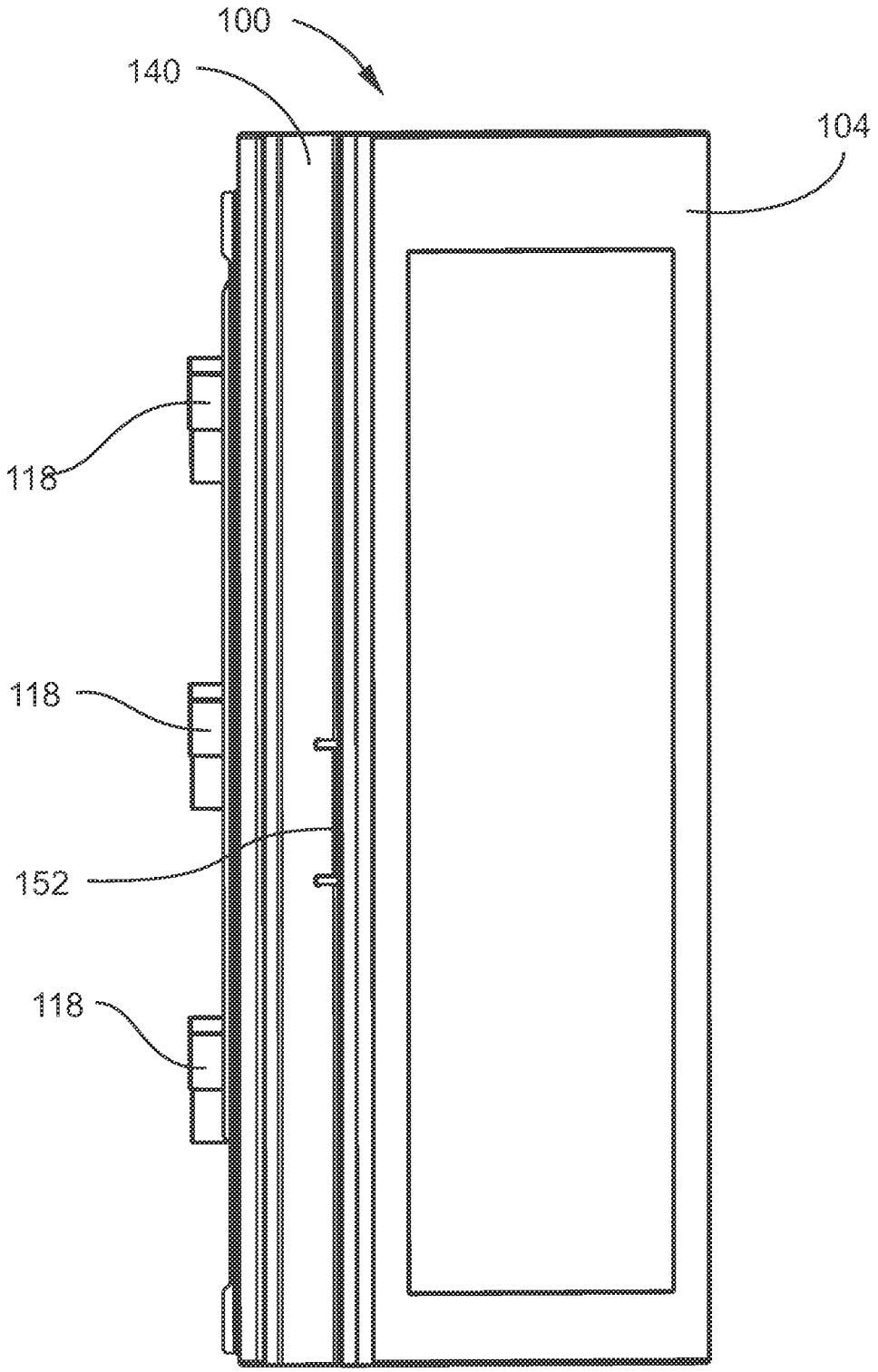
FIG. 9 is an illustration of an embodiment of a handle within a pocket in the second section.
Figure 10:
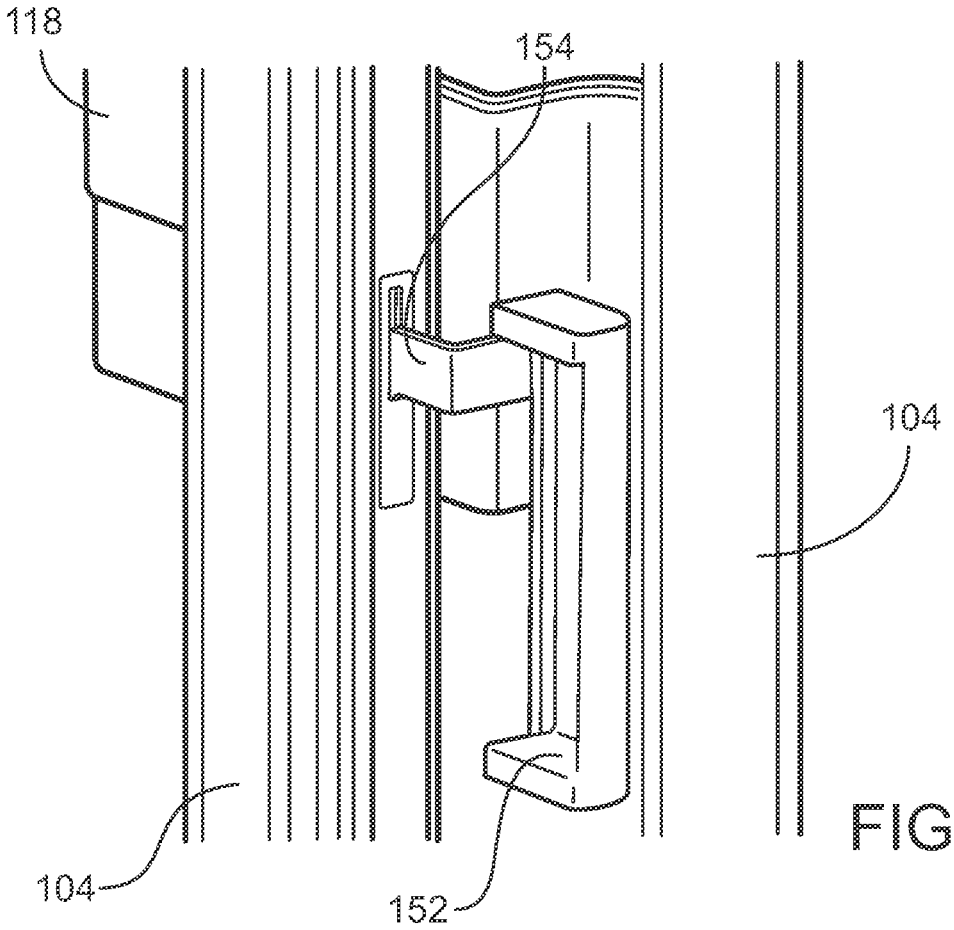
FIG. 10 is an illustration of an embodiment of a handle for a locking mechanism within a pocket in the second section.
Figure 11:
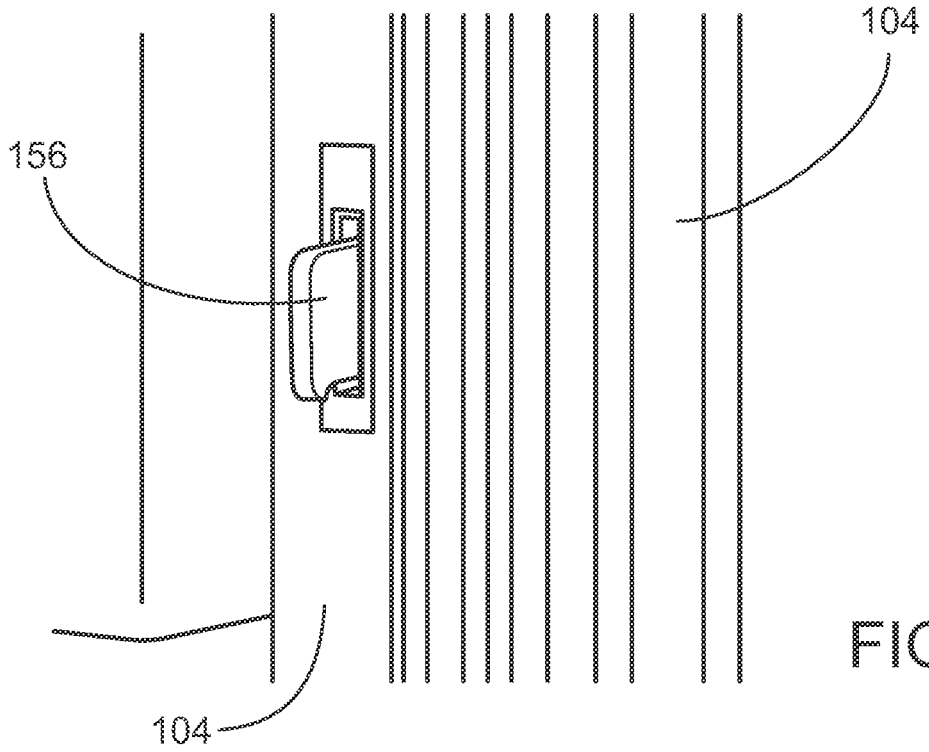
FIG. 11 is an illustration of an embodiment of the latch hook of the locking mechanism that engages the cabinet.

FIGS. 7 and 9-11 illustrate an embodiment of a locking mechanism 150 may be located within second section 104 and is used to open and close second section 104 to first section 102. FIG. 9 shows handle 152 within pocket 140. Handle 152 may be vertically slidable within the pocket 140 and is not visible outside the pocket, particularly when viewing the refrigerator from the front. FIG. 10 shows handle 152 engaging lever arm 154 and FIG. 11 shows latch hook 156 on the interior surface of section 104 that engages a receiving slot 149 (FIG. 5) on the first section 104. In this embodiment, by moving handle 152 vertically operatively connects with latch hook 156 for opening and closing of the second section 104.

Figure 7:
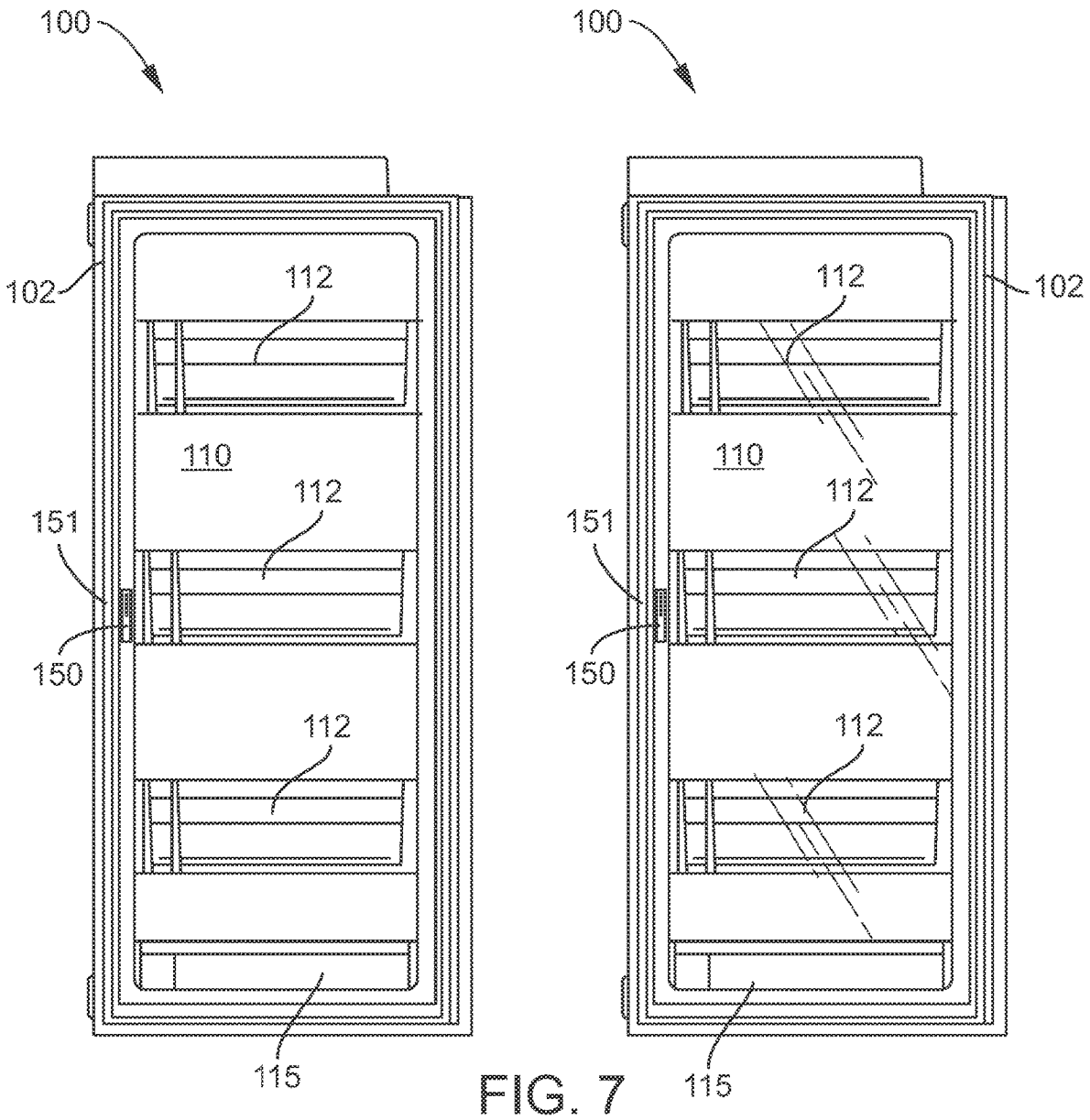
FIG. 7 is an illustration of an embodiment where an internal locking device is positioned to save space in the door.

Referring to FIG. 7, the latch mechanism 150 is positioned on the second section 104 such that it is located within the area bounded by a gasket 151 of the second section 104. Placing the latch mechanism 150 within the area bound by the gasket 151 allows the door 100 to have a clean outer appearance for a user, while also limiting exposure of the latch mechanism 150 to warm ambient air, which could cause frosting problems when the refrigerator is operating.

Figure 12:
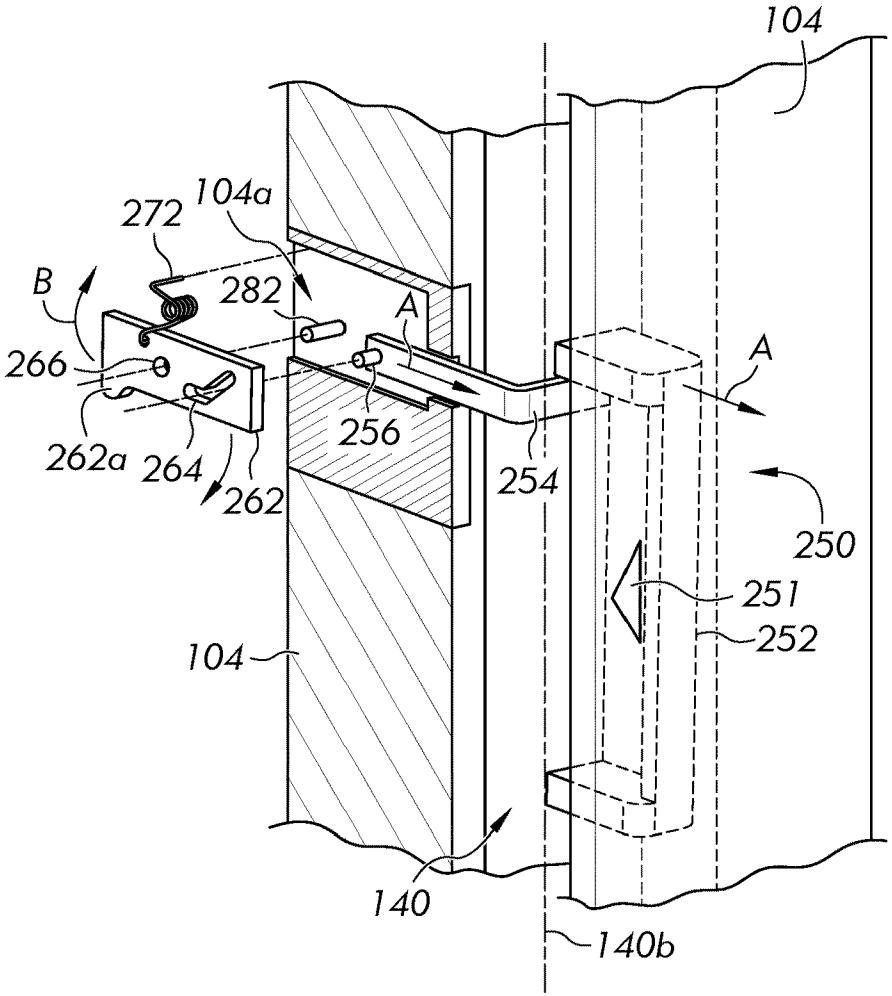
FIG. 12 is an exploded view of a locking mechanism according to a second embodiment.

According to another embodiment, illustrated in FIG. 12, a locking mechanism 250 may include, in general, a handle 252 and a latch hook 262. The handle 252 may be located within the pocket 140 and not be visible to a user from the front of the refrigerator 10. An indicator 251 may be positioned on a front surface of the second section 104 to indicate the hidden location of the handle 252 to the user. In the embodiment shown, the indicator 251 is a triangle. It is contemplated that the indicator 251 may have other shapes, be an embossment or be an illuminated feature on the second section 104.

An arm 254 may extend from the handle 252 and into a cavity 104*a* of the second section 104 wherein the latch hook 262 is disposed. In the embodiment illustrated, the arm 254 is L-shaped but it is contemplated that the arm 254 may have other shapes or configurations so long as it extends from the handle 252 to the latch hook 262. A protrusion 256, e.g., a circular boss, extends from a distal end of the arm 254 and is configured to engage the latch hook 262, as described in detail below.

The latch hook 262 includes a knob or tab 262*a* at a distal end thereof that is dimensioned and positioned to engage the receiving slot 149 (FIG. 5) in the first section 102. The latch hook 262 includes an angled slot 264 that is dimensioned and positioned to receive the protrusion 256, as described in detail below. In the embodiment illustrated, the slot 264 is L-shaped but it is contemplated that it may have other shapes. A hole 266 in the latch hook 262 defines a pivot axis of the latch hook 262.

The latch hook 262 is dimensioned to be received in the cavity 104*a* of the second section 104, in particular, to be pivotal on a stud 282 that is located in the cavity 104*a*. A biasing element 272 may be disposed in the cavity 104*a* to engage the latch hook 262 and bias the latch hook 262 in a downward direction. In the embodiment illustrated, the biasing element 272 is a torsional spring the engages a hole in the latch hook 262 and an upper wall of the cavity 104*a* to apply a downward force to the latch hook 262. It is also contemplated that the biasing element 272 may be a leaf spring or a compression spring that applies a force in a similar manner. It is also contemplated that the biasing element 272 may be an extension spring (not shown) that engages the same hole as the torsional spring and a lower wall of the cavity 104*a*. The extension spring (not shown) may apply a similar downward force to the latch hook 262 to bias it downward toward a bottom of the cavity 104*a*.

The handle 252 and the latch hook 262 are dimensioned and configured such that, when assembled to the second section 104, the arm 254 of the handle may extend into the cavity 104*a* and position the protrusion 256 into the slot 264. The biasing element 272 may bias the latch hook 262 downward. When the user actuates the handle 252 by moving the handle toward the user (i.e., away from door, as represented by arrow A which is perpendicular to a longitudinal axis 140*b* of the pocket handle 140) the protrusion 256 on the arm 254 moves in the same direction. As the protrusion 256 moves, it engages the slot 264 thereby causing the latch hook 262 to pivot in the direction B, i.e., the knob 262*a* pivots in the upward direction. The knob 262*a* on the latch hook 262 may be configured such the pivot motion in the direction B causes the knob 262*a* to disengage from the receiving slot 149 (FIG. 5) in the first section 102 such that the second section 104 is free to pivot away from the first section 102.

When the user releases the handle 252, the biasing element 272 causes the latch hook 262 to pivot in the opposite direction which, in turn, causes the handle 252 to slide back to its unactuated position. Once in this position, the latch hook 262 is free to re-engage the receiving slot 149 (FIG. 5) in the first section 102 when the second section 104 is pivoted back to the closed position adjacent the first section 102.

Figure 13:
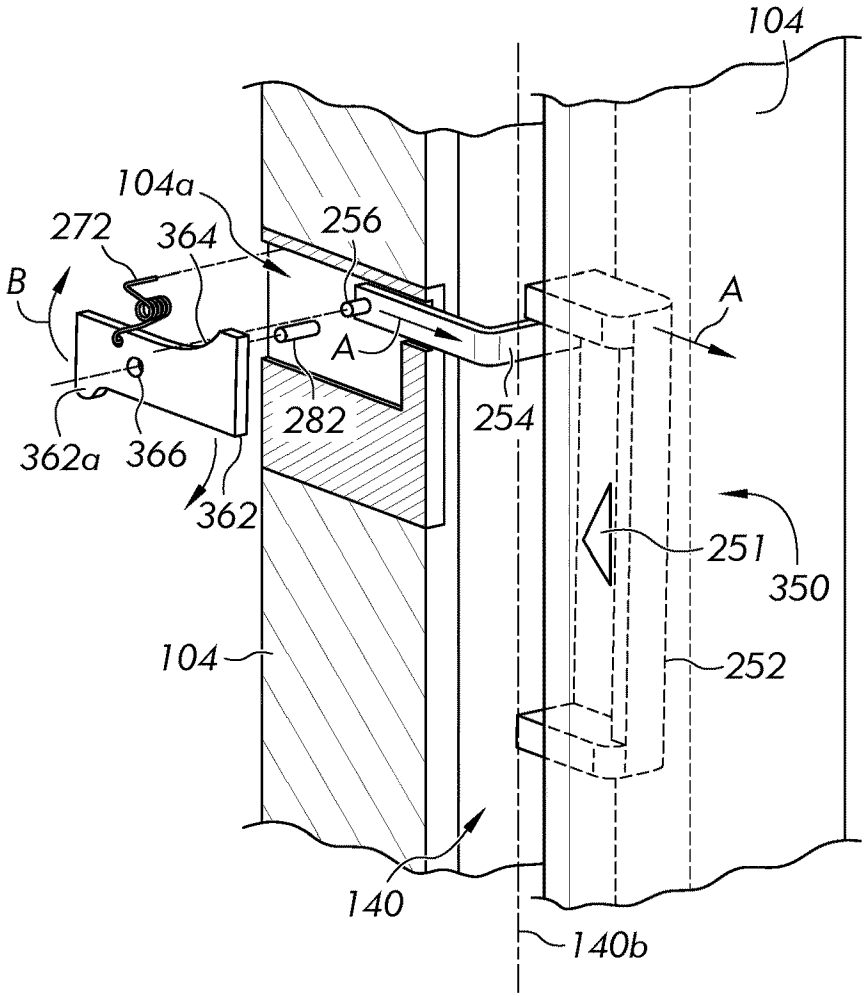
FIG. 13 is an exploded view of a locking mechanism according to a third embodiment.

According to another embodiment, illustrated in FIG. 13, a latch mechanism 350 includes a handle 252 and latch hook 362 similar to that described above for the latch mechanism 250. Accordingly, similar numbers are used in FIG. 13 and the components that are similar will not be described in detail below.

The latch hook 362 is similar to the latch hook 262 except that the slot 264 is removed and a ramp portion 364 which acts as a cam is formed on an upper edge of the latch hook 262. The ramp portion 364 is positioned and dimensioned to engage the protrusion 256 on the handle 252. Similar to the description of the latch mechanism 250 above, the protrusion 256 is configured to engage the ramp portion 364 to cause the latch hook 362 to pivot via hole 366 on stud 282 during actuation of the handle 252. That is, when the user actuates the handle 252 by moving the handle toward the user, the protrusion 256 will move upwards along the ramp portion 364. The angled or curved geometry of the ramp portion 364 provides a cam action to the latch hook 362 in response to the upward motion of the protrusion 256, which thereby causes the latch hook 362 to pivot upon the stud 282 and rotate in the direction of arrow B. Element 272 may bias the latch hook 262 downward so that when the user releases the handle, the protrusion 256 will move in a downward motion along the ramp portion 364 and the latch hook 362 will rotate downwardly to re-engage the receiving slot 149.

The present invention may be embodied in other forms without departing from the spirit and the essential attributes thereof, and, accordingly, reference should be made to the appended claims, rather than to the foregoing specification, as indicating the scope of the invention.

We claim:

1. A refrigerator comprising:

a cabinet housing a refrigerator compartment and having a front opening; and a door providing access to the refrigerator compartment, the door moveable between a closed position wherein the opening is closed and an open position wherein the refrigerator compartment is accessible, the door including:

a first section having an opening for receiving items, a first lateral edge and a second lateral edge, the first lateral edge being hingeably affixed to the cabinet;

a second section having a first lateral edge hingeably affixed to the first lateral edge of the first section and pivotal relative to the first section between a closed position wherein the opening in the first section is closed and an open position wherein the opening in the first section is accessible, the second section including an elongated vertical recess formed in and extending along a second lateral edge opposite the first lateral edge of the second section, the elongated vertical recess defining a pocket handle for moving the door between the closed and open positions; and a locking mechanism for selectively securing the second section to the first section when the second section is in the closed position, the locking mechanism including:

a trigger disposed within the pocket handle, and a latch hook engageable with the trigger for selectively locking the second section in the closed position relative to the first section, wherein the trigger is moveable within the pocket handle and is configured to move the latch hook from a locked position to an unlocked position.

2. The refrigerator according to claim 1, wherein the trigger is slideable within the pocket handle.

3. The refrigerator according to claim 2, wherein the trigger is slideable in a direction perpendicular to a longitudinal axis of the pocket handle.

4. The refrigerator according to claim 1, further comprising a biasing element for biasing the latch hook into the locked position.

5. The refrigerator according to claim 4, wherein the biasing element is a torsional spring, a leaf spring, a compression spring or an extension spring.

6. The refrigerator according to claim 1, wherein the trigger includes a protrusion that engages the latch hook for moving the latch hook from the locked position to the unlocked position when the trigger slides in a first direction within the pocket handle.

7. The refrigerator according to claim 6, wherein the protrusion engages an opening formed in the latch hook.

8. The refrigerator according to claim 6, wherein the protrusion engages a ramped portion on an edge of the latch hook.

9. The refrigerator according to claim 1, further comprising an indicator on a front surface of the second section that is positioned proximate the trigger.

10. The refrigerator according to claim 1, wherein the elongated vertical recess extends an entire vertical length of the second section from a top of the second lateral edge to a bottom of the second lateral edge.

11. The refrigerator according to claim 1, wherein the trigger is located within the pocket handle and is not visible, viewed from a front of the refrigerator, when the door is in the closed position.

* * * * *